US007898361B2

(12) United States Patent
Peng et al.

(10) Patent No.: US 7,898,361 B2
(45) Date of Patent: Mar. 1, 2011

(54) ANTENNA FEED COPLING STRUCTURE OF A DUPLEXER

(75) Inventors: Jen-Ti Peng, Hsi-Chih (TW); Chien-Chih Lee, Hsi-Chih (TW)

(73) Assignee: Universal Microwave Technology, Inc., Hsi-Chih, Taipei Hsien (TW)

( * ) Notice: Subject to any disclaimer, the term of this patent is extended or adjusted under 35 U.S.C. 154(b) by 203 days.

(21) Appl. No.: 12/402,508

(22) Filed: Mar. 12, 2009

(65) Prior Publication Data

US 2009/0231059 A1 Sep. 17, 2009

(30) Foreign Application Priority Data

Mar. 14, 2008 (CN) ..... 09 7 204485

(51) Int. Cl.
*H01P 5/12* (2006.01)

(52) U.S. Cl. ..... 333/134; 333/203

(58) Field of Classification Search ..... 333/122, 333/126, 132, 134, 203, 206, 208, 212, 230, 333/26

See application file for complete search history.

(56) References Cited

U.S. PATENT DOCUMENTS 4,890,078 A * 12/1989 Radcliffe ..... 333/134
4,980,662 A * 12/1990 Simon et al. ..... 333/134
5,751,199 A * 5/1998 Shiau et al. ..... 333/134
5,894,250 A * 4/1999 Ravaska et al. ..... 333/134

* cited by examiner

*Primary Examiner* — Seungsook Ham

(57) ABSTRACT

An antenna feed coupling structure of a duplexer is disclosed to include a base defining a detoured resonance cavity and a T-shaped feed-in cavity perpendicularly intersecting the resonance cavity and a signal input port in connection with the head of the feed-in cavity, a cover closing the base, and adjustment rods mounted in the base and suspending in the resonance cavity and the feed-in cavity. The adjustment rods include two feed-in adjustment rods and two coupling structure adjustment rods suspending in the intersected area between the resonance cavity and the feed-in cavity and respectively kept in horizontal and in vertical relative to the resonance cavity and rotatable inwards and outwards to adjust the feed-in amount and coupling structure amount of the antenna feed coupling structure respectively.

6 Claims, 5 Drawing Sheets

ANTENNA FEED COPLING STRUCTURE OF A DUPLEXER

This Application Claims the Priority Benefit of Taiwan Patent Application Number 097204485 filed on Mar. 14, 2008.

BACKGROUND OF THE INVENTION

1. Field of the Invention

The present invention relates to an antenna duplexer and more particularly, to an antenna feed coupling structure of a duplexer, which allows adjustment of the depth in which two feed-in adjustment rods and two coupling structure adjustment rods enter a resonance cavity and a feed-in cavity, achieving accurate resonance frequency and proper coupling structure amount for smooth operation of signal at both the transmitter side and the receiver side. The antenna feed coupling structure eliminates any soldering techniques, saving the manufacturing cost and facilitating small-size design.

2. Description of the Related Art

FIG. 5 illustrates an antenna feed coupling structure of a duplexer according to the prior art. According to this design, the antenna feed coupling structure comprises a hollow base A that defines therein a resonance cavity A1, a plurality of upright resonators A2 arranged in the resonance cavity A1, two output port A3 respectively connected to one upright resonator A2 at each of two distal ends of the resonance cavity A1 and extended out of one side of the base A, a signal input port A4 cut through the bottom wall of the base A and disposed at one side relative to the resonance cavity A1, a groove A5 extended from a middle part of the resonance cavity A1 toward the signal input port A4, a first feed line A6 connected between two upright resonators A2 are disposed in the resonance cavity A1 at two opposite sides relative to the groove A5, a second feed line A7 perpendicularly extended from the first feed line A6 through the groove A5 into the signal input port A4, and a cover B covering the hollow base A.

When wishing to adjust the magnetic coupling structure amount among the upright resonators A2, change the length of first feed line A6 at each of two sides relative to the second feed line A7 and the length of the second feed line A7, and therefore the resonance frequency, feed-in amount and equivalent length are relatively adjusted. However, when changing the length of the first feed line A6 and the second feed line A7, the distance between the two associating upright resonators A2 as well as the length and location of the groove A5 must be relatively changed. When extending the distance between the two associating upright resonators and the length the groove, the size of the antenna feed coupling structure will be relatively increased.

Further, when making duplexers for different frequency bands to satisfy different clients, different sizes of antenna feed coupling structures must be prepared. In consequence, the antenna feed coupling structure manufacturing cost will be relatively increased. Following market development trend toward light, thin, short and small characteristics, the aforesaid prior art design cannot meet market requirements.

Therefore, it is desirable to provide an antenna feed coupling structure for duplexer that eliminates the aforesaid drawbacks.

SUMMARY OF THE INVENTION

The present invention has been accomplished under the circumstances in view. It is one object of the present invention to provide an antenna feed coupling structure for duplexer, which has small-size and low manufacturing cost characteristics. It is another object of the present invention to provide an antenna feed coupling structure for duplexer, which allows easy adjustment of the feed-in amount and coupling structure amount without any soldering techniques.

To achieve these and other objects of the present invention, an antenna feed coupling structure of a duplexer includes a base defining a detoured resonance cavity and a T-shaped feed-in cavity perpendicularly intersecting the resonance cavity and a signal input port in connection with the head of the feed-in cavity, a cover closing the base, and adjustment rods mounted in the base and suspending in the resonance cavity and the feed-in cavity. The adjustment rods include two feed-in adjustment rods and two coupling structure adjustment rods suspending in the intersected area between the resonance cavity and the feed-in cavity and respectively kept in horizontal and in vertical relative to the resonance cavity and rotatable inwards and outwards to adjust the feed-in amount and coupling structure amount of the antenna feed coupling structure respectively.

DETAILED DESCRIPTION OF THE PREFERRED EMBODIMENT

Figure 1:
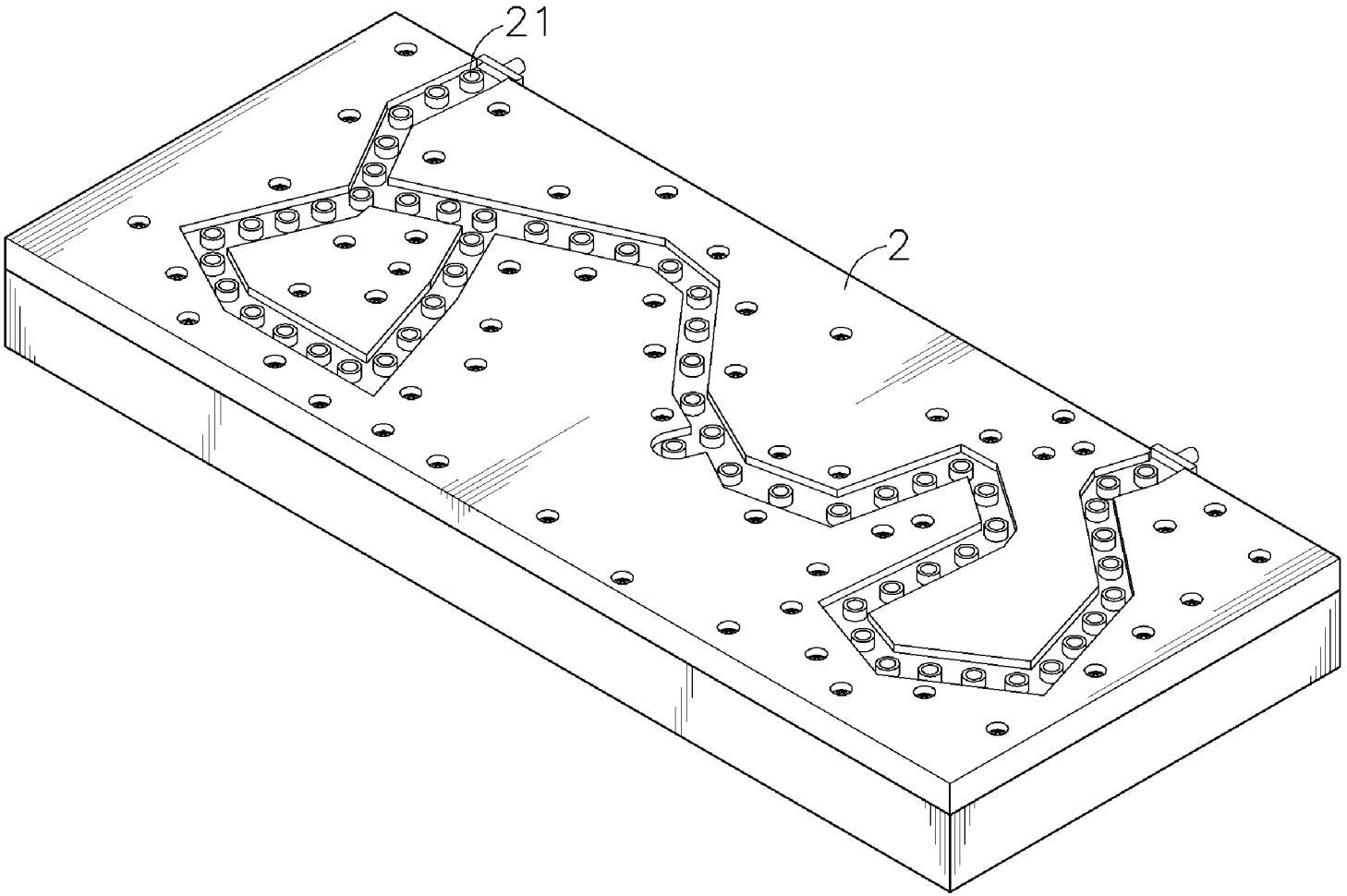
FIG. 1 is an oblique elevation of an antenna feed coupling structure in accordance with the present invention.
Figure 2:
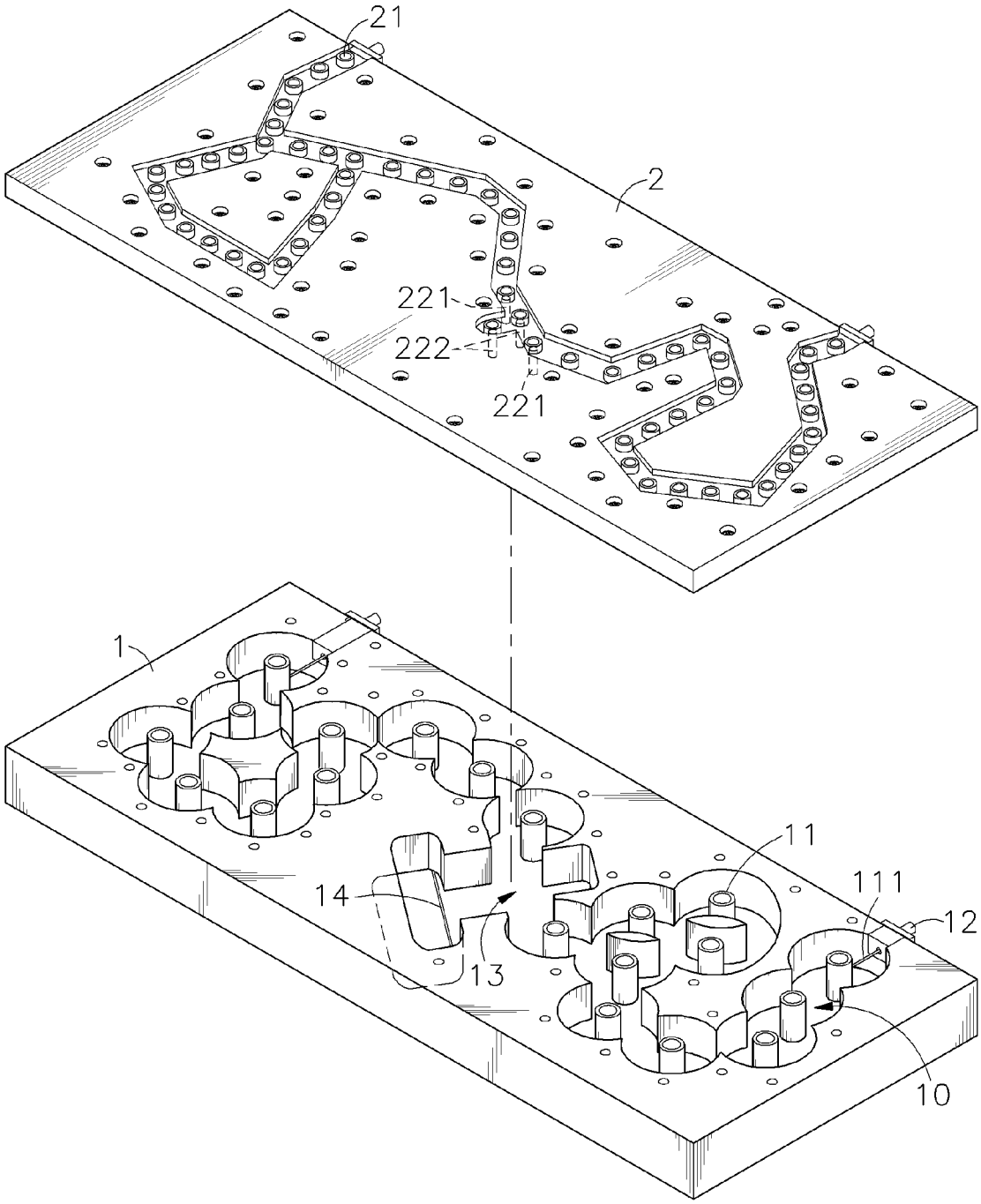
FIG. 2 is an exploded view of the antenna feed coupling structure in accordance with the present invention.
Figure 3:
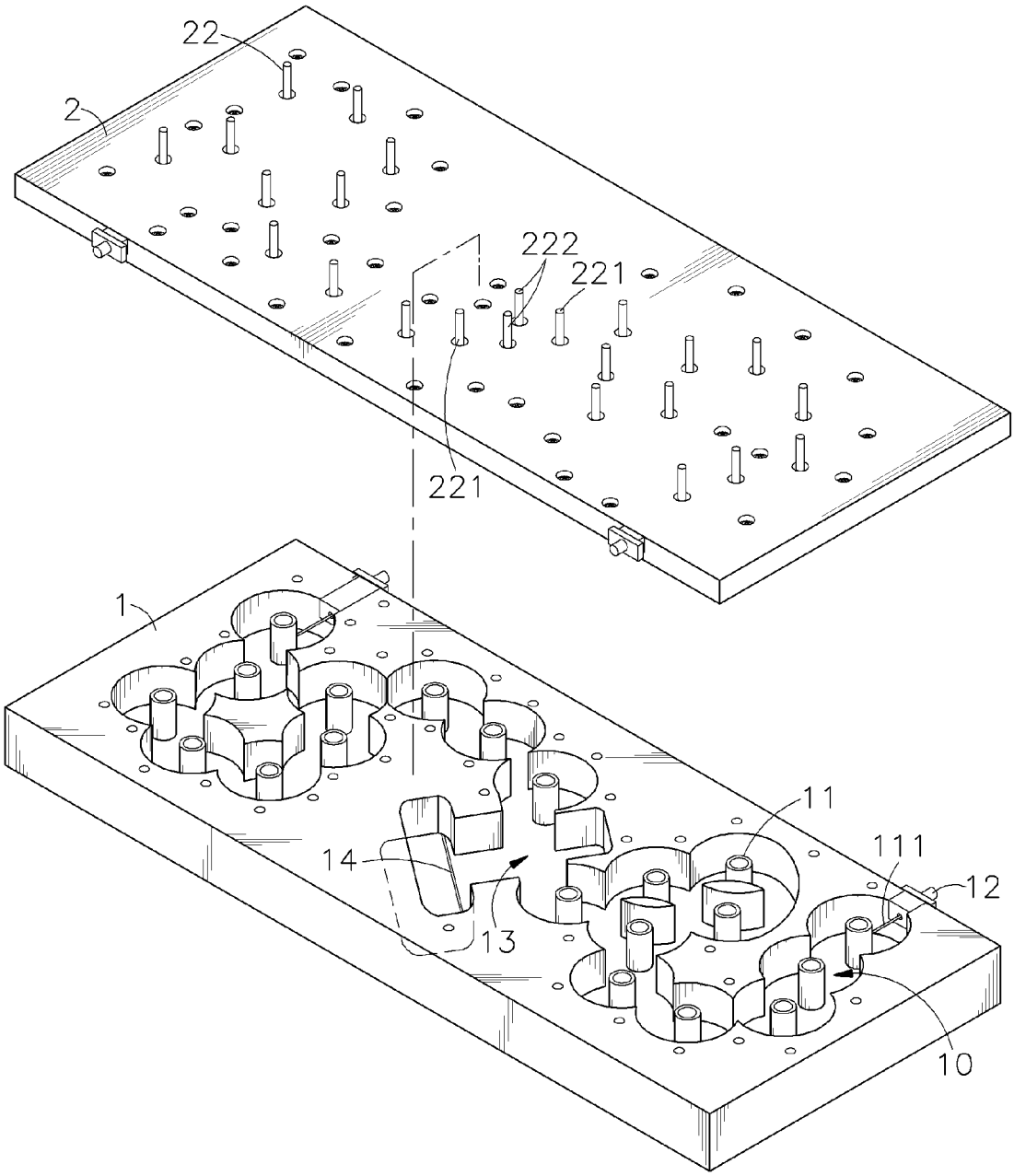
FIG. 3 corresponds to FIG. 2, showing the cover turned upside down.
Figure 4:
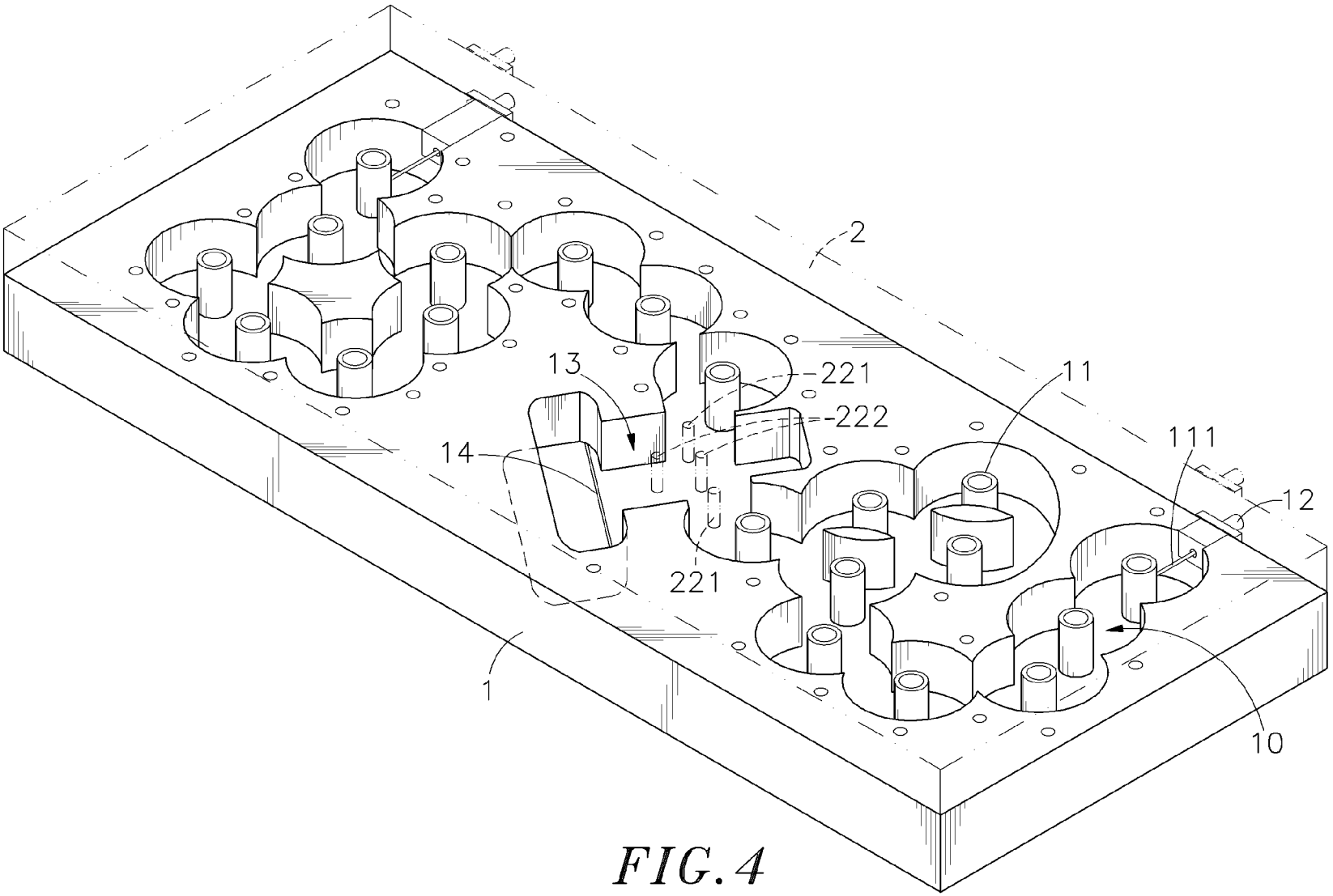
FIG. 4 is a schematic perspective view of the antenna feed coupling structure in accordance with the present invention.
Figure 5:
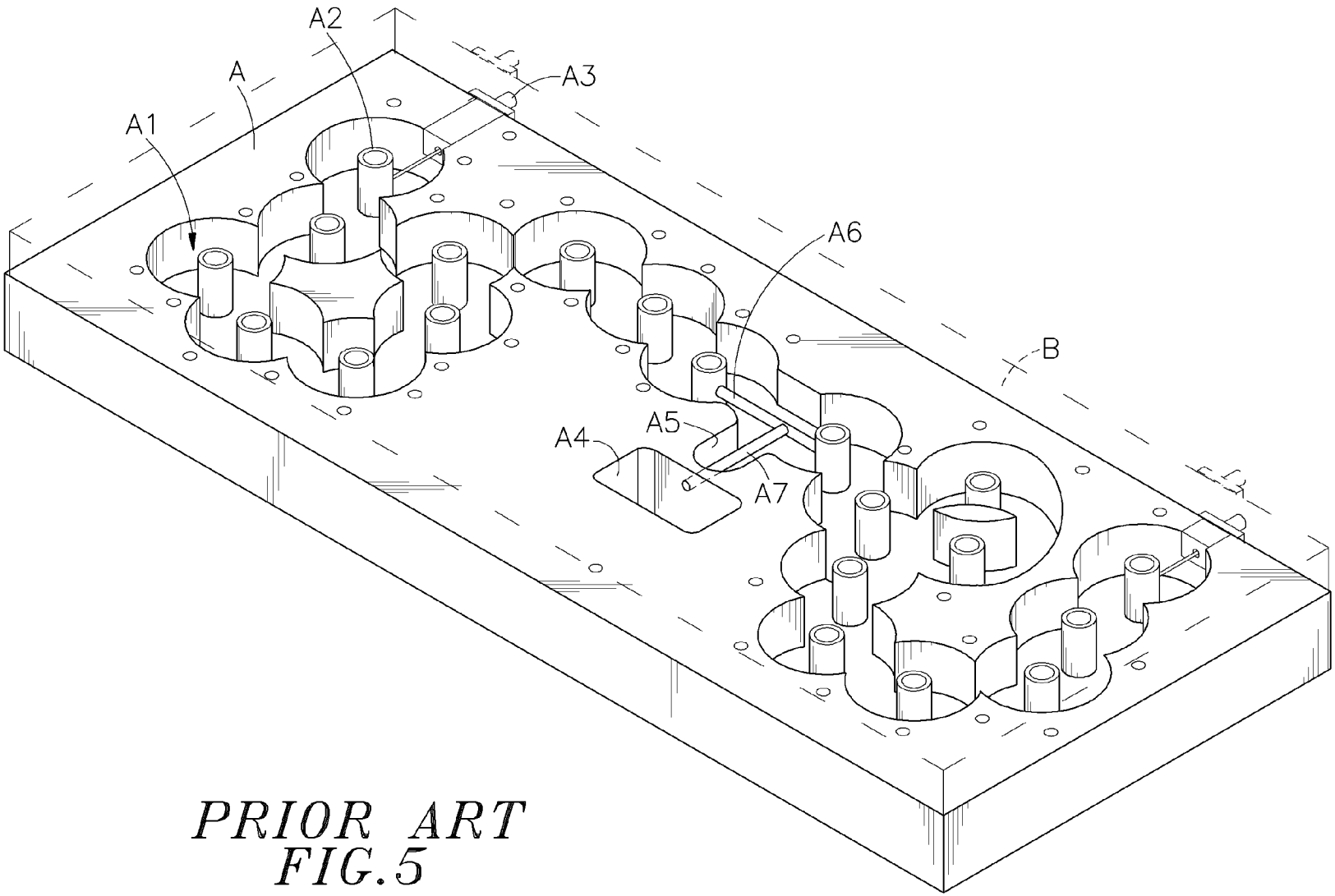
PRIOR ART FIG. 5
FIG. 5 is a schematic perspective view of an antenna feed coupling structure according to the prior art.

Referring to FIGS. 1~4, an antenna feed coupling structure of a duplexer in accordance with the present invention is shown comprising a base 1 and a cover 2.

The base 1 comprises a detoured resonance cavity 10, a plurality of upright resonators 11 arranged in the resonance cavity 10, a plurality of, for example, two output port 12 disposed near two distal ends of one side thereof, a plurality of, for example, two metal conductors 111 that connect one respective resonator 11 at each of two distal ends of the resonance cavity 10 to the output port 12 respectively, a T-shaped feed-in cavity 13 perpendicularly intersecting the resonance cavity 10, and a signal input port 14 extended from one end of the T-shaped feed-in cavity 13 remote from the resonance cavity 10 and cut through the bottom wall of the base 1.

The cover 2 comprises a plurality of through holes 21 corresponding to the upright resonators 11, and a plurality of adjustment rods 22 respectively and vertically adjustably mounted in the through holes 21. The adjustment rods 22 include two feed-in adjustment rods 221 and two coupling structure adjustment rods 222 respectively mounted in the four through holes 21 in the intersected area between the resonance cavity 10 and the feed-in cavity 13 and arranged at right angles.

Referring to FIGS. 1~4 again, during the use of the antenna feed coupling structure, incident signal is fed through the T-shaped feed-in cavity 13 into the resonance cavity 10, causing the upright resonators 11 to exhibits resonance. The resonated signal thus produced is outputted through the output port 12. As stated above, the two feed-in adjustment rods 221 and the two coupling structure adjustment rods 222 are disposed in the intersected area between the resonance cavity 10 and the feed-in cavity 13. The two feed-in adjustment rods 221 are disposed at two sides of the feed-in cavity 13 within the resonance cavity 10 and kept in horizontal relative to the resonance cavity 10. The two coupling structure adjustment rods 222 are disposed in the feed-in cavity 13 within the resonance cavity 10 and kept in vertical relative to the resonance cavity 10 and aimed at the signal input port 14 in the feed-in cavity 13.

The adjustment rods 22, including the feed-in adjustment rods 221 and the coupling structure adjustment rods 222, can be screw nails, screw rods, or any other rod members that facilitate adjustment of the position upwards and downwards. When adjusting the two feed-in adjustment rods 221 toward or apart from the bottom side of the resonance cavity 10, the feed-in amount is relatively adjusted. When adjusting the depth in which the two coupling structure adjustment rods 222 enter the resonance cavity 10, the coupling structure amount is relatively adjusted. During a wireless signal transmission, noises usually will be produced. By means of rotating the feed-in adjustment rods 221 and the coupling structure adjustment rods 222 to adjust the feed-in amount and the coupling structure amount, noises are removed from the input signal, assuring high sharpness of signal and avoiding signal distortion.

Further, a user can directly adjust the depth of the feed-in adjustment rods 221 and the coupling structure adjustment rods 222 in the resonance cavity 10 without detaching the cover 2 from the base 1, and therefore the antenna feed coupling structure is convenient to use. Further, because one single manufacturing tool system is necessary for making antenna feed coupling structures to fit different requirements from different users or clients, saving much the tooling cost and inventory management cost.

Further, the dimension of the feed-in cavity 13 may be changed. When the dimension of the feed-in cavity 13 is reduced, the depth in which the feed-in adjustment rods 221 and the coupling structure adjustment rods 222 enter the resonance cavity 10 is relatively increased, achieving the expected effects. Therefore, the invention allows the feed-in cavity 13 to be small-sized so that the whole dimension of the antenna feed coupling structure can be greatly reduced, providing light, thin, short and small characteristics. Further, the invention eliminates any soldering techniques, saving the manufacturing cost.

In conclusion, the invention provides an antenna feed coupling structure, which has the following advantages and features:

1. The feed-in adjustment rods 221 and the coupling structure adjustment rods 222 are mounted in the cover 2 and suspending in the intersected area between the feed-in cavity 13 and the resonance cavity 10, wherein the feed-in adjustment rods 221 are respectively disposed at two opposite lateral sides of the feed-in cavity 13 within the resonance cavity 10 and adjustable to change the feed-in amount; the coupling structure adjustment rods 222 are kept in vertical relative to the resonance cavity 10 and adjustable to change the coupling structure amount. Therefore, the antenna feed coupling structure can be adjusted to fit different requirements from different users.

2. The feed-in cavity 13 can be made having a T-shaped or profile. Further, the feed-in cavity 13 intersects the resonance cavity 10 in a perpendicular manner. If the dimension of the feed-in cavity 13 is made relatively smaller, the feed-in adjustment rods 221 and the coupling structure adjustment rods 222 are adjusted to enter the resonance cavity and the feed-in cavity 13 relatively deeper, achieving the same coupling structure effect. Therefore, the antenna feed coupling structure of the present invention can be made having light, thin, and short.

A prototype of antenna feed coupling structure has been constructed with the features of FIGS. 1-4. The antenna feed coupling structure functions smoothly to provide all of the features disclosed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An antenna feed coupling structure of a duplexer, comprising:

a base, said base comprising a resonance cavity, a plurality of upright resonators mounted in said resonance cavity, a T-shaped feed-in cavity perpendicularly intersecting said resonance cavity, a signal input port cut through a bottom wall thereof and connected to a top of said T-shaped feed-in cavity remote from said resonance cavity for signal input; and a cover covering said base to close said resonance cavity and said T-shaped feed-in cavity, said cover comprising a plurality of through holes respectively disposed in communication with said resonance cavity and said T-shaped feed-in cavity, and a plurality of adjustment rods respectively mounted in said through holes and adjustable upwards and downwards relative to said resonance cavity and said T-shaped feed-in cavity, said adjustment rods comprising two feed-in adjustment rods and two coupling structure adjustment rods suspending in the intersected area between said resonance cavity and said T-shaped feed-in cavity, said feed-in adjustment rods being aligned in a first direction and adjustable to adjust the feed-in amount of the antenna feed coupling structure, said coupling structure adjustment rods being aligned in a second direction perpendicular to said first direction and adjustable to adjust the coupling structure amount of the antenna feed coupling structure.

2. The antenna feed coupling structure as claimed in claim 1, wherein said resonance cavity is a detoured resonance cavity.

3. The antenna feed coupling structure as claimed in claim 1, further comprising a plurality of output port respectively connected to one said upright resonator at each of two distal ends of said resonance cavity and extended out of said base.

4. The antenna feed coupling structure as claimed in claim 1, wherein said two feed-in adjustment rods are disposed at two opposite lateral sides of said T-shaped feed-in cavity within said resonance cavity and kept in horizontal relative to said resonance cavity.

5. The antenna feed coupling structure as claimed in claim 1, wherein said two coupling structure adjustment rods are kept in vertical relative to said resonance cavity and aimed at said signal input port.

6. The antenna feed coupling structure as claimed in claim 1, wherein said feed-in adjustment rods and said coupling structure adjustment rods are screw members rotatable upwards and downwards relative to said resonance cavity and said T-shaped coupling structure cavity.

* * * * *